US009330599B2

(12) United States Patent
Kim et al.

(10) Patent No.: US 9,330,599 B2
(45) Date of Patent: May 3, 2016

(54) ORGANIC LIGHT EMITTING DISPLAY CAPABLE OF COMPENSATING FOR NOISE OUTPUT FROM A POWER SOURCE SUPPLY UNIT

(71) Applicant: LG DISPLAY CO., LTD., Seoul (KR)

(72) Inventors: Sunghoon Kim, Paju-si (KR); Dongwon Park, Goyang-si (KR); Younghwan Ahn, Paju-si (KR); Yunki Won, Incheon (KR)

(73) Assignee: LG DISPLAY CO., LTD., Seoul (KR)

( * ) Notice: Subject to any disclaimer, the term of this patent is extended or adjusted under 35 U.S.C. 154(b) by 220 days.

(21) Appl. No.: 14/095,564

(22) Filed: Dec. 3, 2013

(65) Prior Publication Data

US 2014/0152643 A1 Jun. 5, 2014

(30) Foreign Application Priority Data

Dec. 4, 2012 (KR) ..... 10-2012-0139349

(51) Int. Cl.
*G09G 3/32* (2006.01)

(52) U.S. Cl.
CPC ..... *G09G 3/3258* (2013.01); *G09G 2330/06* (2013.01)

(58) Field of Classification Search
CPC ..... G09G 3/3258
See application file for complete search history.

(56) References Cited

U.S. PATENT DOCUMENTS 8,248,398 B2 * 8/2012 Cho ..... G09G 3/3648 345/211
2007/0126975 A1 * 6/2007 Choi ..... G02F 1/1309 349/192
2008/0266216 A1 * 10/2008 Choi ..... G09G 3/3258 345/77
2011/0050740 A1 * 3/2011 Lee ..... G09G 3/3233 345/690

FOREIGN PATENT DOCUMENTS

CN 102013227 A 4/2011

* cited by examiner

*Primary Examiner* — Aneeta Yodichkas
*Assistant Examiner* — Karin Kiyabu
(74) *Attorney, Agent, or Firm* — Dentons US LLP

(57) ABSTRACT

Provided is an organic light emitting display including a display panel, a data driver supplying a data signal to the display panel, a timing controller controlling the data driver, a power source supply unit converting an external voltage and outputting a high potential voltage and a low potential voltage through a first power source line and a second power source line, a measurement unit measuring a current or a voltage flowing through the first power source line and the second power source line and outputting a measured value, and a compensation coefficient calculator matching the measured value and a reference value stored in the compensation coefficient calculator to a driving signal and comparing the measured value and the reference value to judge a degree of noise and calculating a compensation coefficient.

8 Claims, 8 Drawing Sheets

ORGANIC LIGHT EMITTING DISPLAY CAPABLE OF COMPENSATING FOR NOISE OUTPUT FROM A POWER SOURCE SUPPLY UNIT

CROSS-REFERENCE TO RELATED APPLICATIONS

This application claims the priority benefit of Korean Patent Application No. 10-2012-0139349 filed on Dec. 4, 2012, which is incorporated herein by reference for all purposes as if fully set forth herein.

BACKGROUND OF THE INVENTION

1. Field of the Invention

An exemplary embodiment of the present invention relates to an organic light emitting display.

2. Discussion of the Related Art

An organic light emitting element used in an organic light emitting display is a self-luminant element including a light emitting layer formed between two electrodes. The organic light emitting element is an element where electrons and holes are injected from an electron injection electrode (cathode) and a hole injection electrode (anode) into the light emitting layer to emit light when an exciton formed by bonding the injected electrons and holes falls from an excited state to a bottom state.

The organic light emitting display using the organic light emitting element is divided into a top-emission mode, a bottom-emission mode, and a dual-emission mode according to an emission direction of light. The organic light emitting display is divided into a passive matrix type and an active matrix type according to a driving mode.

When a scan signal, a data signal, and a power source are supplied to a plurality of subpixels disposed in a matrix form, the organic light emitting display may display an image by allowing the selected subpixels to emit light.

The organic light emitting display controls a driving current flowing through a driving transistor included in the subpixel to adjust brightness of an organic light emitting diode. As described above, the organic light emitting display is embodied in a current driving mode. Therefore, the organic light emitting display is sensitive to a change in current or signal. Accordingly, in the organic light emitting display, when a noise occurs at an output end of a power source supply unit, a plan to be capable of compensating for the noise in consideration of the noise should be found.

SUMMARY OF THE INVENTION

The present invention has been made in an effort to provide an organic light emitting display which is capable of compensating for a noise in consideration of the noise when the noise occurs at an output end of a power source supply unit.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Hereinafter, specific exemplary embodiments of the present invention will be described with reference to the accompanying drawings.

First Exemplary Embodiment

Figure 1:
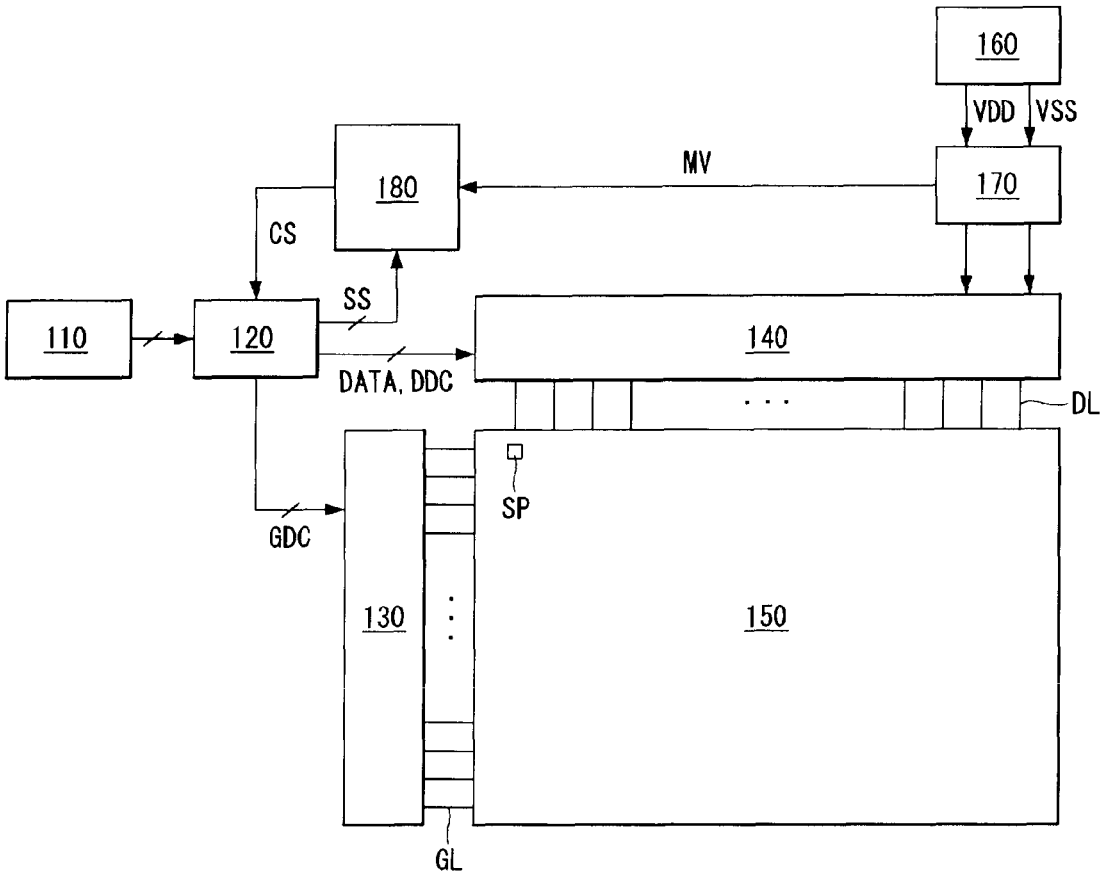
FIG. 1 is a schematic block diagram of an organic light emitting display according to a first exemplary embodiment of the present invention.
Figure 2:
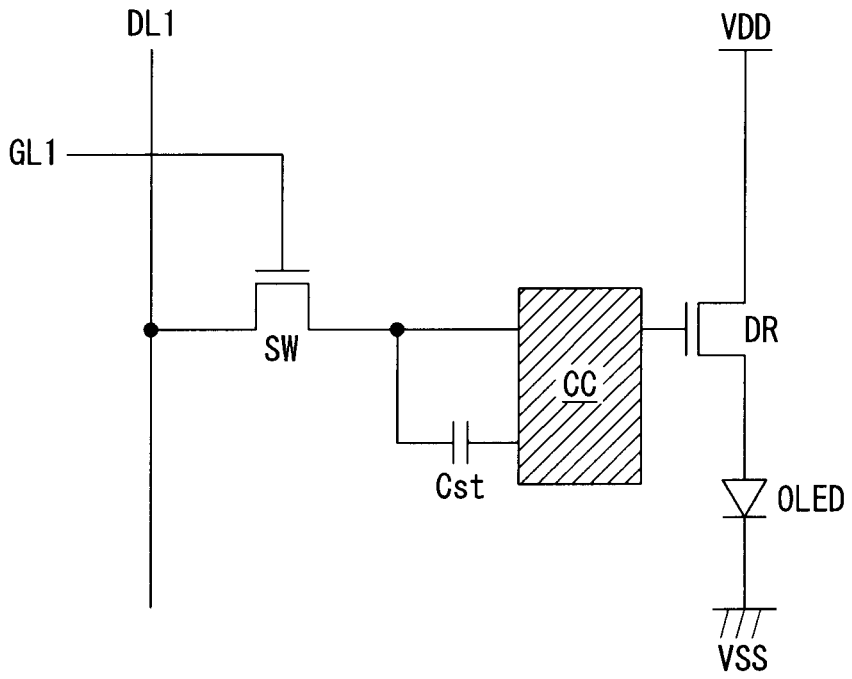
FIG. 2 is an illustrative view of a circuit constitution of a subpixel.

FIG. 1 is a schematic block diagram of an organic light emitting display according to a first exemplary embodiment of the present invention. FIG. 2 is an illustrative view of a circuit constitution of a subpixel.

The organic light emitting display according to the first exemplary embodiment of the present invention includes an image processing unit 110, a timing controller 120, a data driver 140, a gate driver 130, a display panel 150, a power source supply unit 160, a measurement unit 170, and a compensation coefficient calculator 180.

The image processing unit 110 supplies a vertical synchronization signal Vsync, a horizontal synchronization signal Hsync, a data enable signal DE, a clock signal CLK, and a data signal DATA to the timing controller 120.

The timing controller 120 controls operation timing of the data driver 140 and the gate driver 130 by using timing signals such as the vertical synchronization signal Vsync, the horizontal synchronization signal Hsync, the data enable signal DE, and the clock signal CLK supplied from the image processing unit 110. The timing controller 120 may judge a frame period by counting the data enable signal DE of a 1 horizontal period. Accordingly, the vertical synchronization signal Vsync and the horizontal synchronization signal Hsync supplied from the outside may be omitted. A gate timing control signal GDC controlling operation timing of the gate driver 130 and a data timing control signal DDC controlling operation timing of the data driver 140 are included in control signals generated from the timing controller 120. A gate start pulse GSP, a gate shift clock GSC, and a gate output enable signal GOE are included in the gate timing control signal GDC. A source start pulse SSP, a source sampling clock SSC, and a source output enable signal SOE are included in the data timing control signal DDC. The timing controller 120 compensates for the data signal DATA based on a compensation coefficient CS supplied from the compensation coefficient calculator 180.

The gate driver 130 responds to the gate timing control signal GDC supplied from the timing controller 120 to shift a level of a gate driving voltage and sequentially generate gate signals of gate high voltages. The gate driver 130 supplies the gate signals through gate lines GL connected to subpixels SP included in the display panel 150.

The data driver 140 responds to the data timing control signal DDC supplied from the timing controller 120 to sample and latch the data signal DATA supplied from the timing controller 120 to convert the data signal into data of a parallel data system. The data driver 140 converts the data signal DATA in response to a gamma reference voltage. The data driver 140 supplies the data signal DATA through data lines DL connected to the subpixels SP included in the display panel 150.

The display panel 150 includes the subpixels SP disposed in a matrix form. A red subpixel, a green subpixel, and a blue subpixel are included in the subpixels SP. In some cases, a white subpixel is included. Meanwhile, in the display panel 150 including the white subpixel, a light emitting layer of each subpixel SP may not emit lights of red, green, and blue colors, but may emit light of a white color. In this case, light emitted to have a white color is converted into the lights of the red, green, and blue colors by a RGB color filter.

A switching transistor SW, a driving transistor DR, a capacitor Cst, a compensation circuit CC, and an organic light emitting diode OLED are included in one subpixel. The organic light emitting diode OLED is operated so that light is emitted according to a driving current formed by the driving transistor DR. The switching transistor SW responds to the gate signal supplied through a first gate line GL1 to perform a switching operation so that the data signal supplied through a first data line DL1 is stored as a data voltage in the capacitor Cst. The driving transistor DR is operated so that the driving current flows between a first power source line VDD and a second power source line VSS according to the data voltage stored in the capacitor Cst. The compensation circuit CC compensates for a threshold voltage of the driving transistor DR. The compensation circuit CC is constituted by one or more transistors and capacitors. The compensation circuit CC has very diverse constitutions. Accordingly, specific examples and descriptions thereof will be omitted.

One subpixel is constituted to have a 2T (transistor) 1C (capacitor) structure including the switching transistor SW, the driving transistor DR, the capacitor Cst, and the organic light emitting diode OLED. However, the subpixel is constituted to have a 3T1C, 4T2C, or 5T2C structure when the compensation circuit CC is added. The subpixel having the aforementioned constitution is formed in a top-emission mode, a bottom-emission mode, or a dual-emission mode according to the structure.

The power source supply unit 160 converts an external voltage supplied from the outside and outputs a high potential voltage (for example, a level of 20 V) and a low potential voltage (for example, a level of 0 V). The high potential voltage is supplied to the first power source line VDD, and the low potential voltage is supplied to the second power source line VSS. The power source supply unit 160 may output the voltage supplied to the timing controller 120, the data driver 140, and the gate driver 130 in addition to the high potential voltage and the low potential voltage.

The measurement unit 170 measures the current or the voltage flowing through the first power source line VDD and the second power source line VSS. The measurement unit 170 measures the current or the voltage flowing through the first power source line VDD and the second power source line VSS. The measurement unit 170 converts a measured value MV into a digital signal system and outputs the converted value.

The compensation coefficient calculator 180 calculates the compensation coefficient CS based on the measured value MV supplied from the measurement unit 170 and a reference value RV stored therein. The compensation coefficient calculator 180 matches the measured value MV and the reference value RV to a driving signal SS supplied from the timing controller 120 and compares the measured value MV and the reference value RV to calculate the compensation coefficient CS. The compensation coefficient calculator 180 supplies the calculated compensation coefficient CS to the timing controller 120.

Hereinafter, a description regarding a correction of the data signal according to connection of the timing controller 120 and the compensation coefficient calculator 180 will be specified with reference to FIGS. 1 and 2 together.

Figure 3:
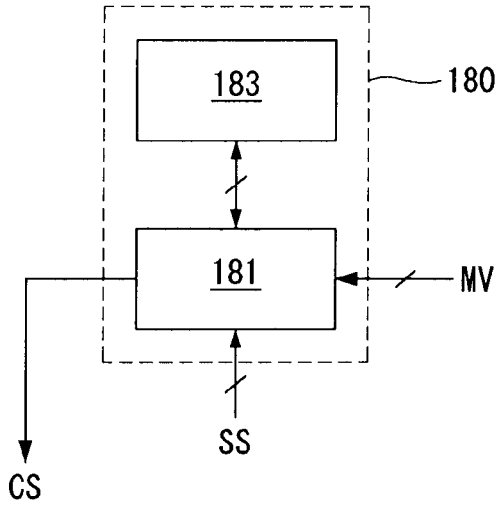
FIG. 3 is an illustrative view of a compensation coefficient calculator.
Figure 4:
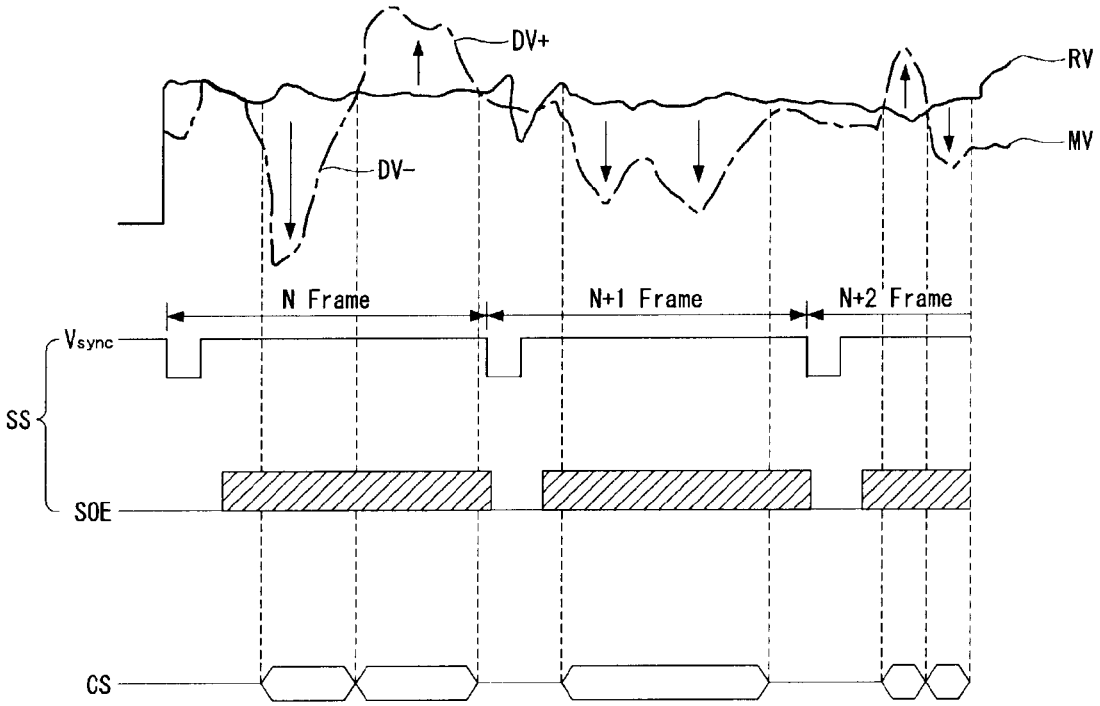
FIG. 4 is a waveform view showing calculation of a compensation coefficient.

FIG. 3 is an illustrative view of the compensation coefficient calculator. FIG. 4 is a waveform view showing calculation of the compensation coefficient.

The compensation coefficient calculator 180 includes a calculator 181 and a storage unit 183. The calculator 181 calculates the compensation coefficient CS in a mode of matching the measured value MV supplied from the measurement unit 170 and the reference value RV stored in the storage unit 183 to the driving signal SS supplied from the timing controller 120 and comparing the measured value MV and the reference value RV.

The timing controller 120 outputs the driving signal SS including the vertical synchronization signal Vsync determining starting of a vertical position of an image displayed on the display panel, the horizontal synchronization signal Hsync determining starting of a horizontal position of the image displayed on the display panel, the data enable signal DE, the clock signal CLK, and the source output enable signal SOE allowing the data signal to be outputted.

The compensation coefficient calculator 180 may match various driving signals SS outputted from the timing controller 120 to the measured value MV and the reference value RV. The compensation coefficient calculator 180 calculates the degree of noise occurring in the current or the voltage flowing through the first power source line VDD and the second power source line VSS at a predetermined time in a mode of matching the driving signal SS to the measured value MV and the reference value RV and comparing the measured value MV and the reference value RV.

Specifically, the compensation coefficient calculator 180 matches the vertical synchronization signal Vsync and the source output enable signal SOE as examples of the driving signal SS to the measured value MV and the reference value RV, and compares the measured value MV and the reference value RV. When the vertical synchronization signal Vsync is matched to the measured value MV and the reference value RV, a period of a frame is obtained. Accordingly, the compensation coefficient calculator 180 may judge which one is the frame where the noise occurs in the current or the voltage. In addition, when the source output enable signal SOE is matched to the measured value MV and the reference value RV, an output time of the data signal is obtained. Accordingly, the compensation coefficient calculator 180 may judge which one is the data signal supplied to cause the noise in the current or the voltage.

When the measured value MV is provided like FIG. 4, the compensation coefficient calculator 180 may judge whether a differential value between the reference value RV and the measured value MV is a positive value DV+ or a negative value DV− through a simple calculation process where the measured value MV is subtracted from the reference value RV. Further, the compensation coefficient calculator 180 may judge which one is the frame where the noise occurs among an N frame to an N+2 frame by counting the periods where the differential value occurs based on the vertical synchronization signal Vsync. Further, the compensation coefficient calculator 180 may judge the degree of noise occurring when a predetermined data signal is supplied during a predetermined frame period by counting the periods where the differential value occurs based on the vertical synchronization signal Vsync and the source output enable signal SOE.

Meanwhile, FIG. 4 shows the reference value RV and the measured value MV slightly exaggerated for understanding and ease of description. In addition, FIG. 4 shows an analog type signal instead of a digital type signal for understanding and ease of description when the differential value between the reference value RV and the measured value MV is calculated. Meanwhile, in the aforementioned description, the vertical synchronization signal Vsync and the source output enable signal SOE are used as examples of the driving signal SS. However, examples of the signal capable of being used as the driving signal SS include various signals such as the clock signal CLK, the horizontal synchronization signal Hsync, the source sampling clock SSC, the gate shift clock GSC, and the gate start pulse GSP.

As described above, the compensation coefficient calculator 180 may judge the degree of noise occurring when a predetermined data signal is supplied during a predetermined frame period. Accordingly, the compensation coefficient calculator 180 may generate the compensation coefficient CS so as to include information about the degree of compensation performed when a predetermined data signal is supplied during a predetermined frame period based on the aforementioned information.

As described above, the compensation coefficient calculator 180 supplies the generated compensation coefficient CS to the timing controller 120. The timing controller 120 compensates for the data signal DATA based on the compensation coefficient CS supplied from the compensation coefficient calculator 180. The timing controller 120 may judge which one is the frame period where compensation should be performed, which one is the data signal supplied at a predetermined time at which compensation should be performed, and the degree of compensation based on information included in the compensation coefficient CS. Accordingly, the timing controller 120 may perform a data signal compensation operation directly compensating for the data signal DATA or a device control compensation operation controlling a device affected by the noise in response to the noise based on the compensation coefficient CS.

For example, when the differential value between the reference value RV and the measured value MV corresponds to the positive value DV+, the timing controller 120 reduces a grayscale of the data signal. When the differential value between the reference value RV and the measured value MV corresponds to the negative value DV−, the timing controller 120 increases the grayscale of the data signal.

When compensation is performed in the aforementioned mode, compensation is not entirely performed with respect to the data signal to be supplied to the display panel 150 during a specific frame period, but is capable of being partially performed with respect to only the data signal affected by the noise. Accordingly, in the present invention, when the noise occurs at an output end of the power source supply unit, in response to this, precise compensation may be partially performed with respect to only a specific frame and a specific data signal.

Meanwhile, in the aforementioned description, supplying of the compensation coefficient CS to the timing controller 120 by the compensation coefficient calculator 180 is described as an example. However, the compensation coefficient CS may be supplied to the image processing unit 110. In this case, the image processing unit 110 compensates for the data signal in response to the compensation coefficient CS. Meanwhile, in the aforementioned description, separate constitution of the compensation coefficient calculator 180 is described as an example. However, the compensation coefficient calculator 180 may be included in the timing controller 120.

Hereinafter, a method for driving the organic light emitting display according to the first exemplary embodiment of the present invention will be described.

Figure 5:
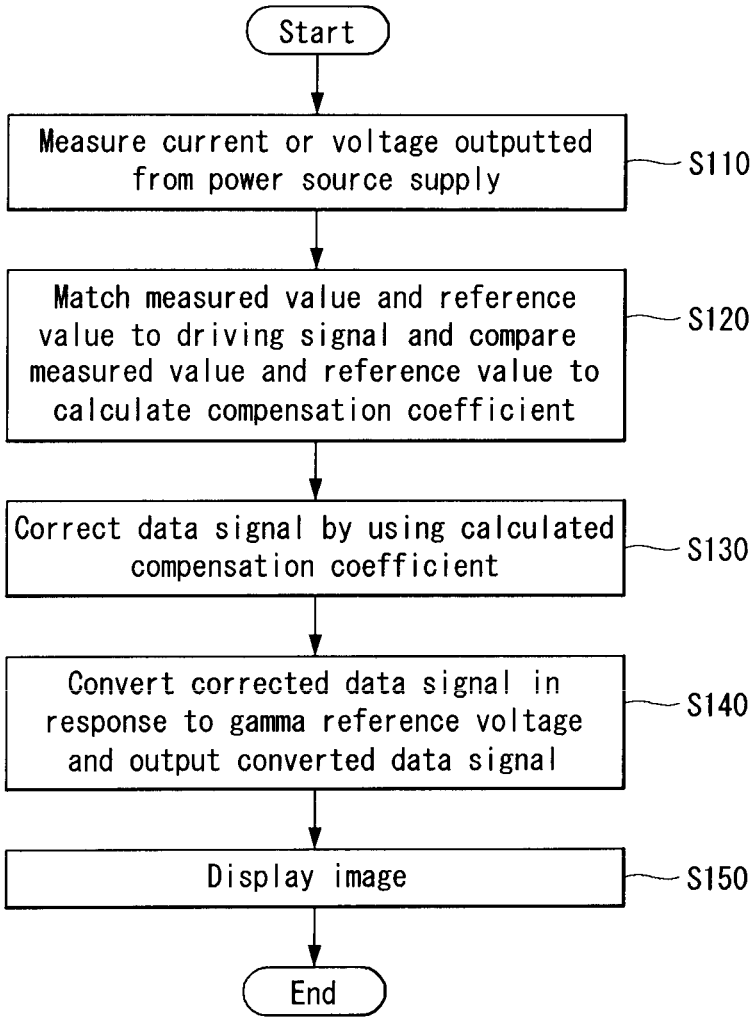
FIG. 5 is a flowchart showing a method for driving the organic light emitting display according to the first exemplary embodiment of the present invention.

FIG. 5 is a flowchart showing the method for driving the organic light emitting display according to the first exemplary embodiment of the present invention.

First, the current or the voltage outputted from the power source supply unit is measured S110. Next, the measured value and the reference value are matched to the driving signal, and compared to calculate the compensation coefficient S120. Next, the data signal is corrected by using the calculated compensation coefficient S130. Next, the corrected data signal is converted in response to the gamma reference voltage, and outputted S140. Next, the image is displayed by using the converted data signal S150.

Second Exemplary Embodiment

Figure 6:
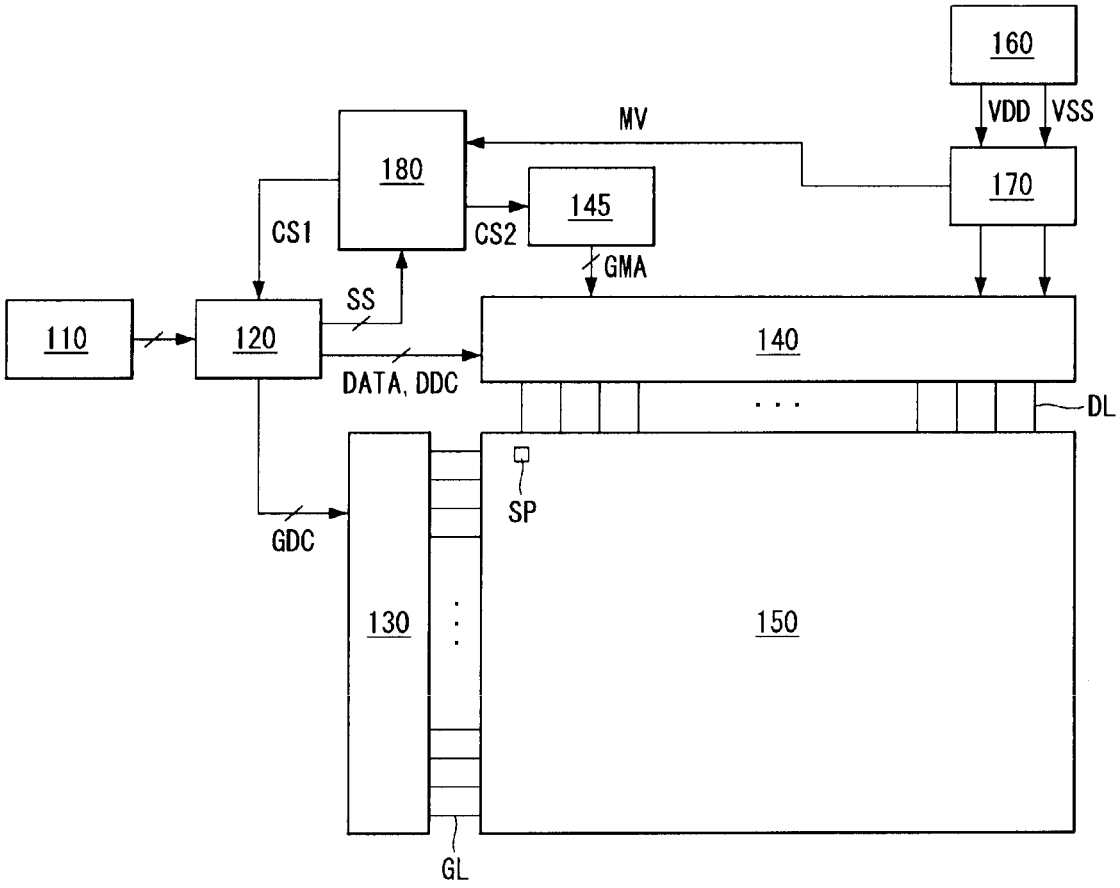
FIG. 6 is a schematic block diagram of an organic light emitting display according to a second exemplary embodiment of the present invention.
Figure 7:
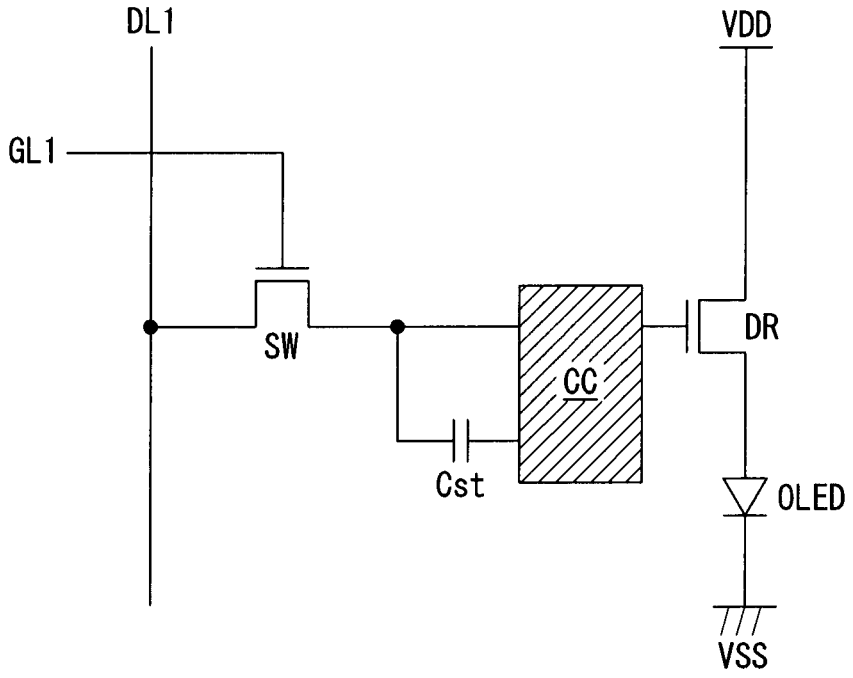
FIG. 7 is an illustrative view of a circuit constitution of a subpixel.

FIG. 6 is a schematic block diagram of an organic light emitting display according to a second exemplary embodiment of the present invention. FIG. 7 is an illustrative view of a circuit constitution of a subpixel.

The organic light emitting display according to the second exemplary embodiment of the present invention includes an image processing unit 110, a timing controller 120, a data driver 140, a gamma unit 145, a gate driver 130, a display panel 150, a power source supply unit 160, a measurement unit 170, and a compensation coefficient calculator 180.

The image processing unit 110 supplies a vertical synchronization signal Vsync, a horizontal synchronization signal Hsync, a data enable signal DE, a clock signal CLK, and a data signal DATA to the timing controller 120.

The timing controller 120 controls operation timing of the data driver 140 and the gate driver 130 by using timing signals such as the vertical synchronization signal Vsync, the horizontal synchronization signal Hsync, the data enable signal DE, and the clock signal CLK supplied from the image processing unit 110. The timing controller 120 may judge a frame period by counting the data enable signal DE of a 1 horizontal period. Accordingly, the vertical synchronization signal Vsync and the horizontal synchronization signal Hsync supplied from the outside may be omitted. A gate timing control signal GDC controlling operation timing of the gate driver 130 and a data timing control signal DDC controlling operation timing of the data driver 140 are included in control signals generated from the timing controller 120. A gate start pulse GSP, a gate shift clock GSC, and a gate output enable signal GOE are included in the gate timing control signal GDC. A source start pulse SSP, a source sampling clock SSC, and a source output enable signal SOE are included in the data timing control signal DDC. The timing controller 120 compensates for the data signal DATA based on a first compensation coefficient CS1 supplied from the compensation coefficient calculator 180.

The gate driver 130 responds to the gate timing control signal GDC supplied from the timing controller 120 to shift a level of a gate driving voltage and sequentially generate gate signals of gate high voltages. The gate driver 130 supplies the gate signals through gate lines GL connected to subpixels SP included in the display panel 150.

The data driver 140 responds to the data timing control signal DDC supplied from the timing controller 120 to sample and latch the data signal DATA supplied from the timing controller 120 to convert the data signal into data of a parallel data system. The data driver 140 converts the data signal DATA in response to a gamma reference voltage GMA. The data driver 140 supplies the data signal DATA through data lines DL connected to the subpixels SP included in the display panel 150.

The gamma unit 145 supplies the gamma reference voltage GMA to the data driver 140. The gamma unit 145 may programmably convert a gamma in response to the signal supplied from the outside. The gamma unit 145 compensates for the gamma reference voltage GMA based on a second compensation coefficient CS2 supplied from the compensation coefficient calculator 180.

The display panel 150 includes the subpixels SP disposed in a matrix form. A red subpixel, a green subpixel, and a blue subpixel are included in the subpixels SP. In some cases, a white subpixel is included. Meanwhile, in the display panel 150 including the white subpixel, a light emitting layer of each subpixel SP may not emit lights of red, green, and blue colors, but may emit light of a white color. In this case, light emitted to have a white color is converted into the lights of the red, green, and blue colors by a RGB color filter.

A switching transistor SW, a driving transistor DR, a capacitor Cst, a compensation circuit CC, and an organic light emitting diode OLED are included in one subpixel. The organic light emitting diode OLED is operated so that light is emitted according to a driving current formed by the driving transistor DR. The switching transistor SW responds to the gate signal supplied through a first gate line GL1 to perform a switching operation so that the data signal supplied through a first data line DL1 is stored as a data voltage in the capacitor Cst. The driving transistor DR is operated so that the driving current flows between a first power source line VDD and a second power source line VSS according to the data voltage stored in the capacitor Cst. The compensation circuit CC compensates for a threshold voltage of the driving transistor DR. The compensation circuit CC is constituted by one or more transistors and capacitors. The compensation circuit CC has very diverse constitutions. Accordingly, specific examples and descriptions thereof will be omitted.

One subpixel is constituted to have a 2T (transistor) 1C (capacitor) structure including the switching transistor SW, the driving transistor DR, the capacitor Cst, and the organic light emitting diode OLED. However, the subpixel is constituted to have a 3T1C, 4T2C, or 5T2C structure when the compensation circuit CC is added. The subpixel having the aforementioned constitution is formed in a top-emission mode, a bottom-emission mode, or a dual-emission mode according to the structure.

The power source supply unit 160 converts an external voltage supplied from the outside and outputs a high potential voltage (for example, a level of 20 V) and a low potential voltage (for example, a level of 0 V). The high potential voltage is supplied to the first power source line VDD, and the low potential voltage is supplied to the second power source line VSS. The power source supply unit 160 may output the voltage supplied to the timing controller 120, the data driver 140, and the gate driver 130 in addition to the high potential voltage and the low potential voltage.

The measurement unit 170 measures the current or the voltage flowing through the first power source line VDD and the second power source line VSS. The measurement unit 170 measures the current or the voltage flowing through the first power source line VDD and the second power source line VSS. The measurement unit 170 converts a measured value MV into a digital signal system and outputs the converted value.

The compensation coefficient calculator 180 calculates the first and second compensation coefficients CS1 and CS2 based on the measured value MV supplied from the measurement unit 170 and a reference value RV stored therein. The compensation coefficient calculator 180 matches the measured value MV and the reference value RV to a driving signal SS supplied from the timing controller 120 and compares the measured value MV and the reference value RV to calculate the first and second compensation coefficients CS1 and CS2. The compensation coefficient calculator 180 supplies the calculated first compensation coefficient CS 1 to the timing controller 120, or supplies the calculated second compensation coefficient CS2 to the gamma unit 145 according to properties of the first and second compensation coefficients CS1 and CS2.

Hereinafter, a description regarding a correction of the data signal and the gamma reference voltage according to connection of the timing controller 120, the gamma unit 145, and the compensation coefficient calculator 180 will be specified with reference to FIGS. 6 and 7 together.

Figure 8:
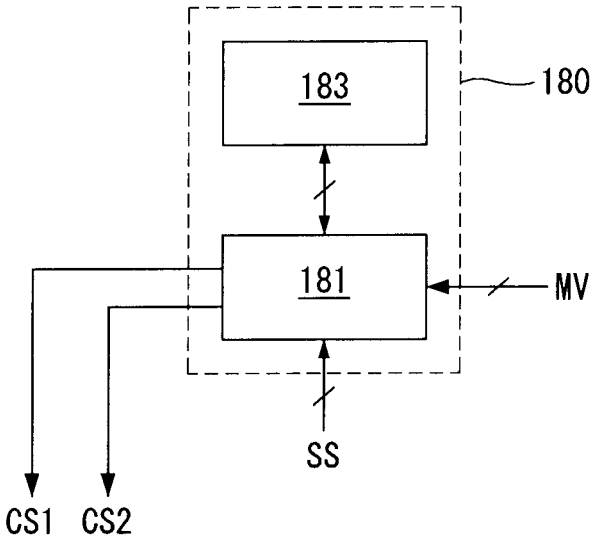
FIG. 8 is an illustrative view of a compensation coefficient calculator.
Figure 9:
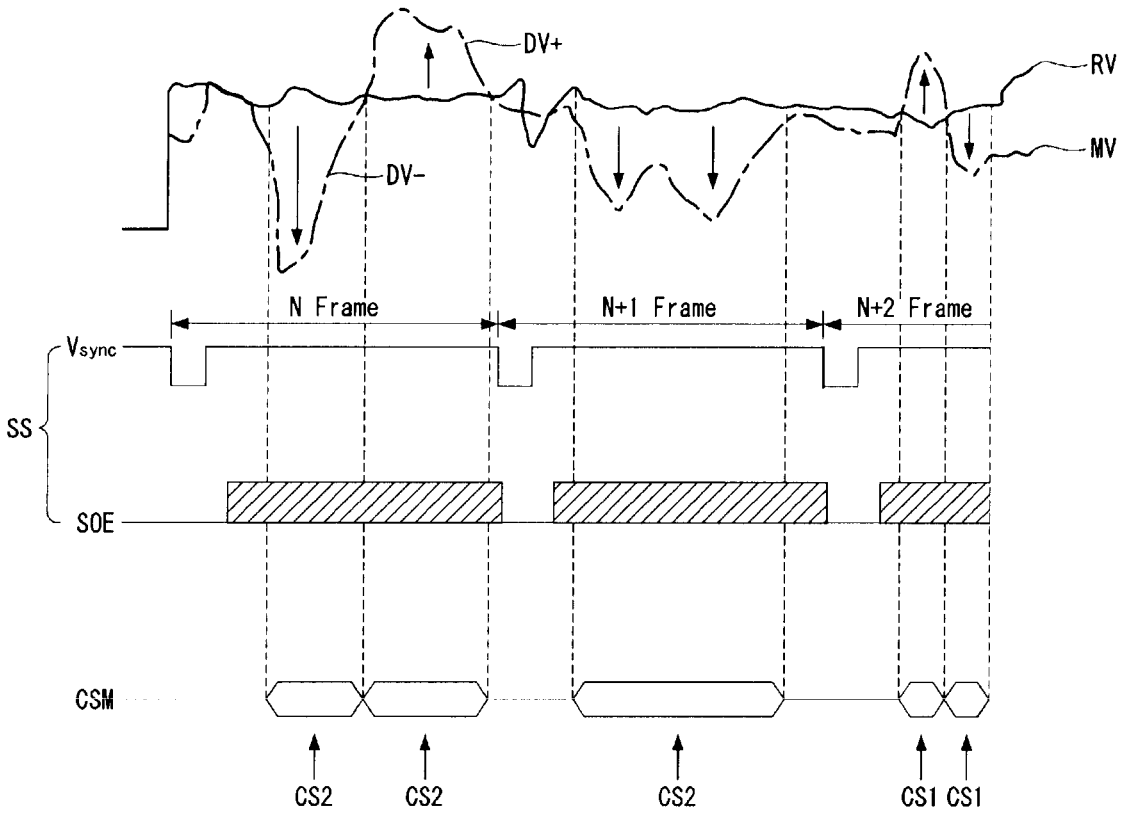
FIG. 9 is a waveform view showing calculation of a compensation coefficient.

FIG. 8 is an illustrative view of the compensation coefficient calculator. FIG. 9 is a waveform view showing calculation of the compensation coefficient.

The compensation coefficient calculator 180 includes a calculator 181 and a storage unit 183. The calculator 181 calculates the first and second compensation coefficients CS1 and CS2 in a mode of matching the measured value MV supplied from the measurement unit 170 and the reference value RV stored in the storage unit 183 to the driving signal SS supplied from the timing controller 120 and comparing the measured value MV and the reference value RV.

The timing controller 120 outputs the driving signal SS including the vertical synchronization signal Vsync, the horizontal synchronization signal Hsync, the data enable signal DE, the clock signal CLK, and the source output enable signal SOE.

The compensation coefficient calculator 180 may match various driving signals SS outputted from the timing controller 120 to the measured value MV and the reference value RV. The compensation coefficient calculator 180 calculates the degree of noise occurring in the current or the voltage flowing through the first power source line VDD and the second power source line VSS at a predetermined time in a mode of matching the driving signal SS to the measured value MV and the reference value RV and comparing the measured value MV and the reference value RV.

Specifically, the compensation coefficient calculator 180 matches the vertical synchronization signal Vsync and the source output enable signal SOE as examples of the driving signal SS to the measured value MV and the reference value RV, and compares the measured value MV and the reference value RV. When the vertical synchronization signal Vsync is matched to the measured value MV and the reference value RV, a period of a frame is obtained. Accordingly, the compensation coefficient calculator 180 may judge which one is the frame where the noise occurs in the current or the voltage. In addition, when the source output enable signal SOE is matched to the measured value MV and the reference value RV, an output time of the data signal is obtained. Accordingly, the compensation coefficient calculator 180 may judge which one is the data signal supplied to cause the noise in the current or the voltage.

When the measured value MV is provided like FIG. 9, the compensation coefficient calculator 180 may judge whether a differential value between the reference value RV and the measured value MV is a positive value DV+ or a negative value DV− through a simple calculation process where the measured value MV is subtracted from the reference value RV. Further, the compensation coefficient calculator 180 may judge which one is the frame where the noise occurs among an N frame to an N+2 frame by counting the periods where the differential value occurs based on the vertical synchronization signal Vsync. Further, the compensation coefficient calculator 180 may judge the degree of noise occurring when a predetermined data signal is supplied during a predetermined frame period by counting the periods where the differential value occurs based on the vertical synchronization signal Vsync and the source output enable signal SOE.

Meanwhile, FIG. 9 shows the reference value RV and the measured value MV slightly exaggerated for understanding and ease of description. In addition, FIG. 9 shows an analog type signal instead of a digital type signal for understanding and ease of description when the differential value between the reference value RV and the measured value MV is calculated. Meanwhile, in the aforementioned description, the vertical synchronization signal Vsync and the source output enable signal SOE are used as examples of the driving signal SS. However, examples of the signal capable of being used as the driving signal SS include various signals such as the clock signal CLK, the horizontal synchronization signal Hsync, the source sampling clock SSC, the gate shift clock GSC, and the gate start pulse GSP.

As described above, the compensation coefficient calculator 180 may generate the first and second compensation coefficients CS1 and CS2 so as to include information about the degree of noise occurring when a predetermined data signal is supplied during a predetermined frame period.

The compensation coefficient calculator 180 distinguishes the first and second compensation coefficients CS1 and CS2 according to the degree of effect of the noise on a device or a signal after a main compensation coefficient CSM is calculated so that the timing controller 120 and the gamma unit 145 perform appropriate compensation.

The compensation coefficient calculator 180 allocates a portion of the main compensation coefficient CSM to the first compensation coefficient CS1 so that the timing controller 120 performs compensation with respect to the period where the small differential value occurs between the reference value RV and the measured value MV (in other words, a portion where the effect of the noise is low). In addition, the compensation coefficient calculator 180 allocates another portion of the main compensation coefficient CSM to the second compensation coefficient CS2 so that the gamma unit 140 performs compensation with respect to the period where the large differential value occurs between the reference value RV and the measured value MV (in other words, a portion where the effect of the noise is high).

The timing controller 120 and the gamma unit 145 compensates for the data signal DATA and the gamma reference voltage GMA, respectively, based on the first and second compensation coefficients CS1 and CS2 supplied from the compensation coefficient calculator 180. The timing controller 120 and the gamma unit 145 may judge which one is the frame period where compensation should be performed, which one is the data signal supplied at a predetermined time at which compensation should be performed, and the degree of compensation based on information included in the first and second compensation coefficients CS1 and CS2. Accordingly, the timing controller 120 may perform a data signal compensation operation directly compensating for the data signal DATA or a device control compensation operation controlling the device affected by the noise in response to the noise based on the first compensation coefficient CS1. In addition, the gamma unit 145 may perform a gamma compensation operation compensating for the gamma reference voltage GMA based on the second compensation coefficient CS2.

For example, when the differential value between the reference value RV and the measured value MV corresponds to the positive value DV+, the timing controller 120 reduces a grayscale of the data signal. When the differential value between the reference value RV and the measured value MV corresponds to the negative value DV−, the timing controller 120 increases the grayscale of the data signal. In addition, when the differential value between the reference value RV and the measured value MV corresponds to the positive value DV+, the gamma unit 145 reduces the gamma reference voltage. When the differential value between the reference value RV and the measured value MV corresponds to the negative value DV−, the gamma unit 145 increases the gamma reference voltage.

When compensation is performed in the aforementioned mode, compensation is not entirely performed with respect to the data signal to be supplied to the display panel 150 during a specific frame period, but is capable of being partially performed with respect to only the data signal affected by the noise. Accordingly, in the present invention, when the noise occurs in the power source supply unit, in response to this, precise compensation may be performed by changing the gamma reference voltage when a specific data signal is supplied during a specific frame together with partial compensation with respect to a specific frame and a specific data signal.

Meanwhile, in the aforementioned description, supplying of the first and second compensation coefficients CS1 and CS2 to the timing controller 120 and the gamma unit 145 by the compensation coefficient calculator 180 is described as an example. However, the first compensation coefficient CS1 may be supplied to the image processing unit 110. In this case, the image processing unit 110 compensates for the data signal in response to the first compensation coefficient CS1. Meanwhile, in the aforementioned description, separate constitution of the compensation coefficient calculator 180 is described as an example. However, the compensation coefficient calculator 180 may be included in the timing controller 120.

Hereinafter, a method for driving the organic light emitting display according to the second exemplary embodiment of the present invention will be described.

Figure 10:
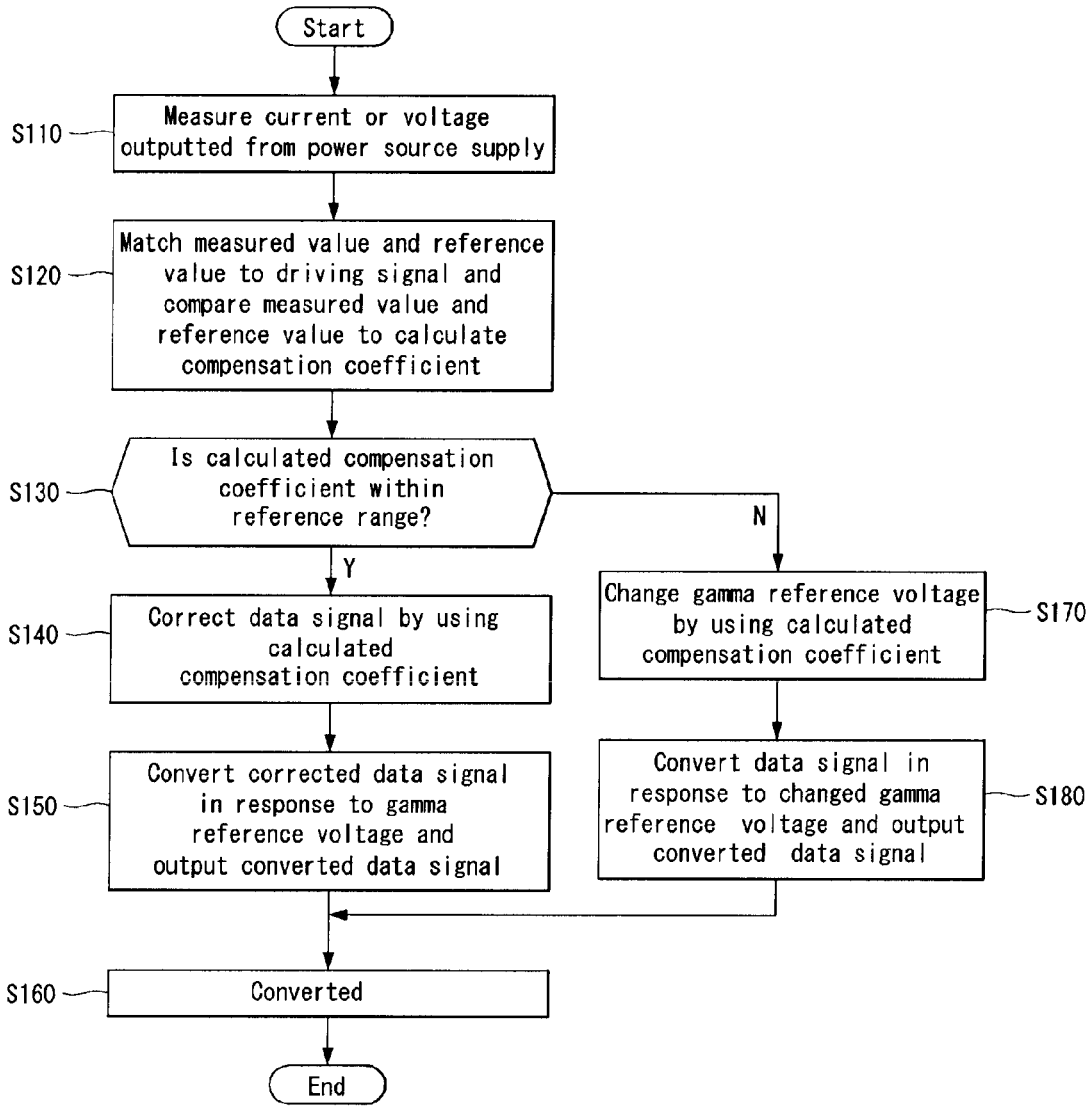
FIG. 10 is a flowchart showing a method for driving the organic light emitting display according to the second exemplary embodiment of the present invention.

FIG. 10 is a flowchart showing the method for driving the organic light emitting display according to the second exemplary embodiment of the present invention.

First, the current or the voltage outputted from the power source supply unit is measured S110. Next, the measured value and the reference value are matched to the driving signal, and compared to calculate the compensation coefficient S120. Next, whether the calculated compensation coefficient is within a reference range or not is judged S130. When the calculated compensation coefficient is within the reference range Y, the data signal is corrected by using the calculated compensation coefficient S140. Next, the corrected data signal is converted in response to the gamma reference voltage, and outputted S150. Next, an image is displayed by using the converted data signal S160.

On the other hand, when the calculated compensation coefficient is more than the reference range N, the gamma reference voltage is changed by using the calculated compensation coefficient S170. Next, the data signal is converted in response to the changed gamma reference voltage, and outputted S180. Next, the image is displayed by using the converted data signal S160.

In the present invention, when the noise occurs in the power source supply unit, in response to this, precise compensation may be partially performed with respect to only a specific frame and a specific data signal. Further, in the present invention, when the noise occurs at an output end of the power source supply unit, in response to this, precise compensation may be performed by changing the gamma reference voltage when a specific data signal is supplied during a specific frame together with partial compensation with respect to a specific frame and a specific data signal.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel;

a data driver supplying a data signal to the display panel;

a timing controller controlling the data driver;

a power source supply unit converting an external voltage supplied from an outside and outputting a high potential voltage and a low potential voltage through a first power source line and a second power source line;

a measurement unit measuring a current or a voltage flowing through the first power source line and the second power source line from the power source supply unit and outputting a measured value; and a compensation coefficient calculator matching the measured value and a reference value stored in the compensation coefficient calculator to a driving signal supplied from the timing controller and comparing the measured value and the reference value to judge a degree of noise occurring at an output end of the power source supply unit, and calculating a compensation coefficient according to the degree of noise, wherein the compensation coefficient is supplied to the timing controller and includes information of a specific frame period and specific data signal to compensate, and wherein the timing controller compensates the specific data signal during the specific frame period based on the information of the compensation coefficient.

2. The organic light emitting display of claim 1, wherein the compensation coefficient calculator judges whether a differential value between the reference value and the measured value is a positive value or a negative value through a simple calculation process where the measured value is subtracted from the reference value.

3. The organic light emitting display of claim 2, wherein the timing controller reduces a grayscale of the data signal when the compensation coefficient corresponds to the positive value and increases the grayscale of the data signal when the compensation coefficient corresponds to the negative value.

4. The organic light emitting display of claim 1, wherein the driving signal includes a vertical synchronization signal determining starting of a vertical position of an image displayed on the display panel and a source output enable signal allowing the data signal to be outputted.

5. An organic light emitting display comprising:

a display panel;

a data driver supplying a data signal to the display panel;

a gamma unit supplying a gamma reference voltage to the data driver;

a timing controller controlling the data driver;

a power source supply unit converting an external voltage supplied from an outside and outputting a high potential voltage and a low potential voltage through a first power source line and a second power source line;

a measurement unit measuring a current or a voltage flowing through the first power source line and the second power source line from the power source supply unit and outputting a measured value; and a compensation coefficient calculator matching the measured value and a reference value stored in the compensation coefficient calculator to a driving signal supplied from the timing controller and comparing the measured value and the reference value to judge a degree of noise occurring at an output end of the power source supply unit, and calculating a main compensation coefficient, wherein the main compensation coefficient includes first and second compensation coefficients used to distinguishably correct the data signal and the gamma reference voltage according to the degree of noise, wherein the first and second compensation coefficients include information about a degree of compensation performed when a predetermined data signal is supplied during a predetermined frame period, wherein a first portion of the main compensation coefficient is allocated to the first compensation coefficient and supplied to the timing controller such that the timing controller compensates a data signal during a specific time period having a small differential value between the reference value and the measured value, and wherein a second portion of the main compensation coefficient is allocated to the second compensation coefficient and supplied to the gamma unit such that the gamma unit compensates the gamma reference voltage when a large differential value occurs between the reference value and the measured value.

6. The organic light emitting display of claim 5, wherein the compensation coefficient calculator judges whether the small differential value and the large differential value between the reference value and the measured value is a positive value or a negative value through a simple calculation process where the measured value is subtracted from the reference value.

7. The organic light emitting display of claim 6, wherein the timing controller reduces a grayscale of the data signal when the first compensation coefficient corresponds to the positive value and increases the grayscale of the data signal when the first compensation coefficient corresponds to the negative value, and the gamma unit reduces the gamma reference voltage when the second compensation coefficient corresponds to the positive value and increases the gamma reference voltage when the second compensation coefficient corresponds to the negative value.

8. The organic light emitting display of claim 5, wherein the driving signal includes a vertical synchronization signal determining starting of a vertical position of an image displayed on the display panel and a source output enable signal allowing the data signal to be outputted.

* * * * *